US005167532A

United States Patent [19]

Bruno et al.

[11] Patent Number: 5,167,532

[45] Date of Patent: Dec. 1, 1992

[54] CAPTIVATION ASSEMBLY OF DIELECTRIC ELEMENTS FOR SUPPORTING AND RETAINING A CENTER CONTACT IN A COAXIAL CONNECTOR

[75] Inventors: Saverio T. Bruno; David J. Critelli, both of Danbury, Conn.

[73] Assignee: Insulated Wire Incorporated, Ronkonkoma, N.Y.

[21] Appl. No.: 780,735

[22] Filed: Oct. 18, 1991

[51] Int. Cl.[5] ..... H01R 17/04

[52] U.S. Cl. ..... 439/578; 439/752

[58] Field of Search ..... 439/578-585, 439/675, 741, 751, 736, 752

[56] References Cited

U.S. PATENT DOCUMENTS

| | | | |
|---|---|---|---|
| 4,456,324 | 6/1984 | Staeger et al. | 439/578 |
| 4,611,873 | 9/1986 | Punako et al. | 439/578 |
| 4,718,864 | 1/1988 | Flanagan et al. | 439/578 |
| 4,867,703 | 9/1989 | Flanagan et al. | 439/578 |
| 4,957,456 | 9/1990 | Olsson et al. | 439/578 |

OTHER PUBLICATIONS

Page I 51 of Catalog of Radiall, Inc., "SMA 2.9 General"—Copyright date 1989.

*Primary Examiner*—David L. Pirlot

*Attorney, Agent, or Firm*—Parmelee, Bollinger & Bramblett

[57] ABSTRACT

A captivation assembly for supporting and retaining a center contact of a coaxial connector includes a plurality of dielectric elements, preferably three, captured in concave seats in a contact support member which is located on the axis of the connector and to which the center contact is secured. These concave seats face radially outwardly on the contact support member and are uniformly angularly spaced about the axis of the connector. A retainer ring of generally hollow cylindrical configuration is included in the assembly of the outer conductive body of the connector. This retainer ring encircles the assembly of dielectric elements for retaining them in their respective seats in supporting and holding relationship. The captivation assembly desirably minimizes the amount of dielectric material while securely supporting and holding the center contact for resisting displacement of the center contact both radially and axially. By virtue of its minimized dielectric material, the coaxial connector is adapted for successful operation at gigaHertz frequencies. The dielectric elements are shown as short cylindrical elements each having an axial through hole for reducing the overall effective dielectric constant of the captivation assembly. In one embodiment of these dielectric elements, such through hole is enlarged at each axial end by a counterbore for creating an increased air section for providing an electrical compensation zone.

31 Claims, 3 Drawing Sheets

CAPTIVATION ASSEMBLY OF DIELECTRIC ELEMENTS FOR SUPPORTING AND RETAINING A CENTER CONTACT IN A COAXIAL CONNECTOR

FIELD OF THE INVENTION

The present invention is in the field of coaxial connectors for making connections with the ends of coaxial cables, and more particularly relates to center contact captivation assemblies in "coaxial connectors", as defined herein, including coaxial adaptors, plugs, jacks, terminations and the like for use in the GigaHertz frequency range for supporting and holding the center contact in fixed position for resisting displacement both radially and axially within the connector body when external forces are applied either by the center conductor of the cable or by external forces directly applied to the center contact itself or both.

BACKGROUND

A dielectric support bead or other dielectric support structure serves to support and to hold the center contact within the connector body of a coaxial connector. Important parameters relating to the performance of the connector are: the effective inner and outer diameter of the dielectric support structure, its effective dielectric constant, the impedance of the dielectric support structure and its axial length. The effective dielectric constant should be as low as possible for preventing electrical resonances of the dielectric support structure from occurring below the upper limit of the connector operating frequency range. In other words, a lower effective dielectric constant in the support structure helps to achieve a coaxial connector that can operate at a higher frequency limit.

U.S. Pat. No. 4,867,703, in which one of the present inventors is an inventor, discloses a dielectric support bead for holding the center conductor of a coaxial connector. The dielectric support bead includes three radially-extending legs, with each leg terminating in a shoe-like cylindrical support surface. There is an annular shroud extending radially integral with the three legs and with the three shoe-like support surfaces. This shroud serves as an environmental barrier or block for preventing contaminants, such as metal flakes, from migrating into internal portions of the connector. As can be seen from looking at the drawings in U.S. Pat. No. 4,867,703, the dielectric support bead shown therein has a complex configuration which is difficult and expensive to fabricate.

The purpose of the complex structure disclosed in the '703 patent is to reduce the total amount of dielectric material in the support head for reducing the effective dielectric constant of the support bead as a whole.

Another arrangement for reducing the total amount of dielectric material in a support bead is shown in FIG. 1 herein. The support bead 80 in FIG. 1 is the Hewlett Packard Bead. Three shallow holes 82 are drilled spaced 120° apart on a first side of the bead. These shallow holes, which are drilled in an axial direction, do not penetrate all of the way through the bead 80, so that the undrilled remaining material serves as an environmental block. Then, three more shallow holes (not seen) spaced 120° apart are drilled in an axial direction on the second side of the bead and do not penetrate all of the way through the bead. These latter three shallow holes are offset 60° from the shallow holes 82 on the first side of the dielectric head, so that the holes on opposite sides of the bead alternate in occurrence with each other. It is difficult, time-consuming and expensive to drill six accurately positioned shallow holes (three on each axial end) in each support bead.

A third arrangement for reducing the total amount of dielectric material in a support bead is shown in FIG. 2. The support bead 84 in FIG. 2 is known as a "standard six-hole bead". Six holes 86 are drilled in an axial direction through the bead 84. It is difficult, time-consuming and expensive to drill six accurately positioned holes 86 extending axially through a support bead. Moreover, these six holes 86 only remove a modest percentage of the total material in the bead 84.

A fourth arrangement for reducing the total amount of dielectric material in a dielectric support structure for the center contact of a coaxial connector is called the Radiall star support design as is shown on page I51 from a catalog of RADIALL, INC., which we believe is a company in France having a manufacturing facility in Stratford, Conn. The catalog in which page I51 appears bears a copyright date of 1989.

Among the problems associated with the Radiall star support design are non-stability and non-rigidity with minimal mechanical strength. The four bowed Kapton strips retain their individual flexibilities and thereby cause flexibility in support for the inner contact with minimal mechanical strength in support of this inner contact.

SUMMARY

A coaxial connector has a plural-dielectric-element captivation assembly for supporting and retaining the center conductor of the connector. This captivation assembly includes a plurality of dielectric elements uniformly angularly spaced around the axis of the coaxial connector. There are preferred to be three of these dielectric elements, and they are captured in respective concave seats in a conductive support member to which the center contact is secured.

These concave seatsface radially outwardly on the contact support member and are uniformly angularly spaced around the axis of the coaxial connector for individually receiving the respective dielectric elements inserted therein in a close-fitting mating relationship. A retainer ring of generally hollow cylindrical configuration is included in the assembly, this retainer ring being associated with the outer conductive body of the connector. This retainer ring encircles the assembly of dielectric elements for retaining them firmly seated in their respective seats in relatively rigid supporting and holding relationship for the center contact support member This captivation assembly including such a plurality of dielectric elements advantageously avoids the need for expensive plastic molding equipment as is often required for producing certain types of molded dielectric beads in the prior art. Moreover, this captivation assembly desirably minimizes the amount of dielectric material involved in supporting and holding the center contact support member in captivated relationship, thereby relatively rigidly securing the center contact for resisting displacement of the center contact both radially and axially. As a result of minimizing the amount of dielectric material, the dielectric constant of the coaxial connector remains quite low for preventing electrical resonance of the dielectric support structure from occurring below a relatively high operating frequency limit in the gigaHertz frequency range for this coaxial connector.

The plurality of dielectric elements in the captivation assembly are shown as being short circular cylinder elements.

Each such dielectric unit has an axial through hole for reducing the overall effective dielectric constant of the captivation assembly. In one embodiment of these dielectric elements there is a counterbore enlargement at each end of the axial through hole for creating an increased air section for providing an electrical compensation zone near each end of captivation assembly.

In accordance with the present invention in an illustrative embodiment, there is provided a coaxial connector having an axis with forward and rear directions relative to this axis. This coaxial connector comprises a center conductor concentric with the axis and having a plurality of seats facing radially outwardly with a plurality of dielectric elements engaging individually in the respective concave seats. An outer electrical conductor encircles the dielectric elements for holding them engaging in their respective seats. Forward and rear shoulders within the coaxial connector prevent the dielectric elements from moving forwardly and rearwardly relative to the inner and outer conductors, thereby holding the inner conductor in captivated relationship relative to the outer conductor.

BRIEF DESCRIPTION OF THE DRAWINGS

The invention, together with further objects, features, advantages and aspects thereof will be more clearly understood from the following description considered in conjunction with the accompanying drawings which are not necessarily drawn to scale with the emphasis instead being placed upon clearly illustrating the principles of the invention. Like reference numerals indicate like elements throughout the different views.

FIG. 7 shows a male connector with a rotatable coupling nut at its front end.

DETAILED DESCRIPTION OF PREFERRED EMBODIMENTS

Figure 3:
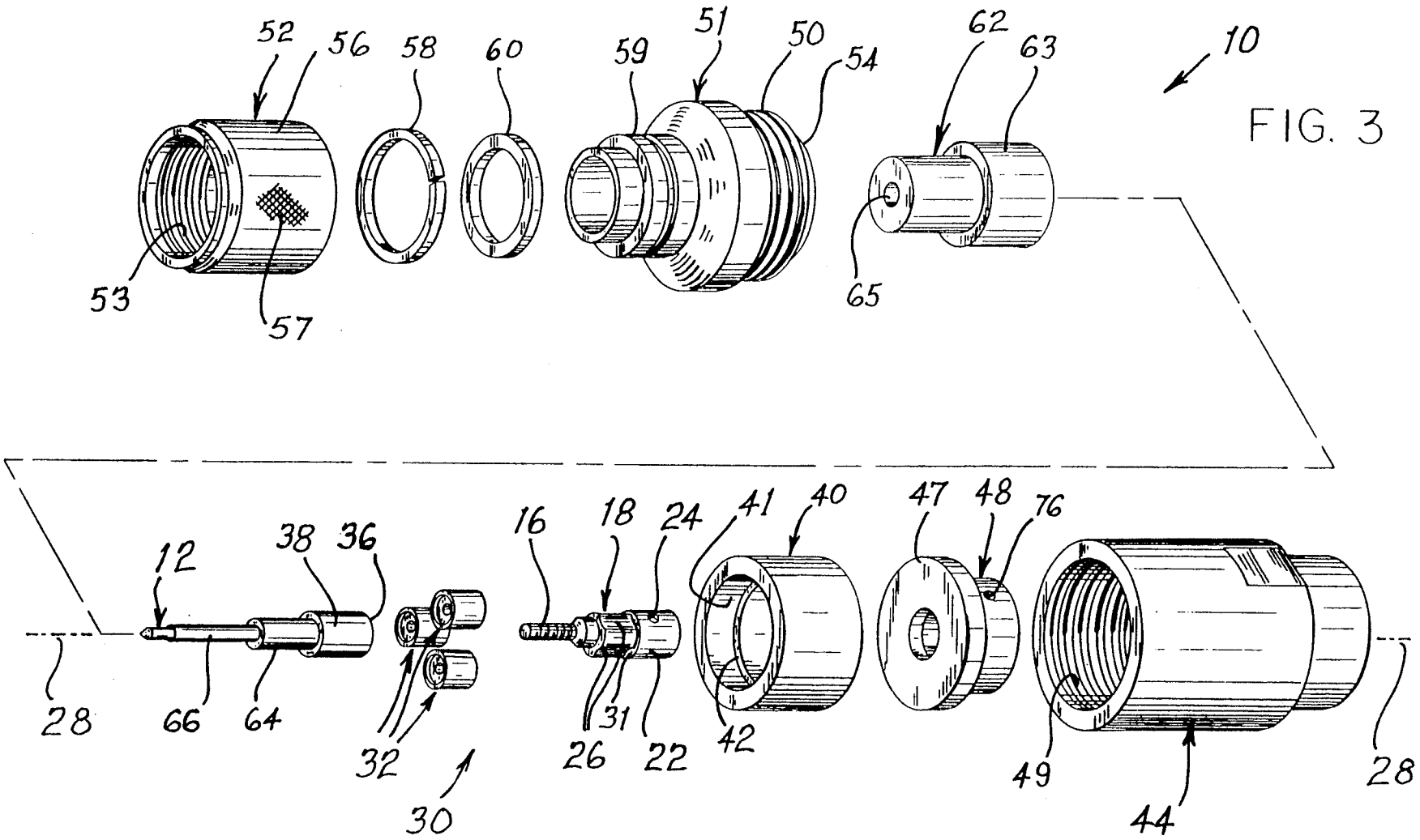
FIG. 3 is an enlarged perspective view of a disassembled coaxial connector embodying the present invention.
Figure 7:
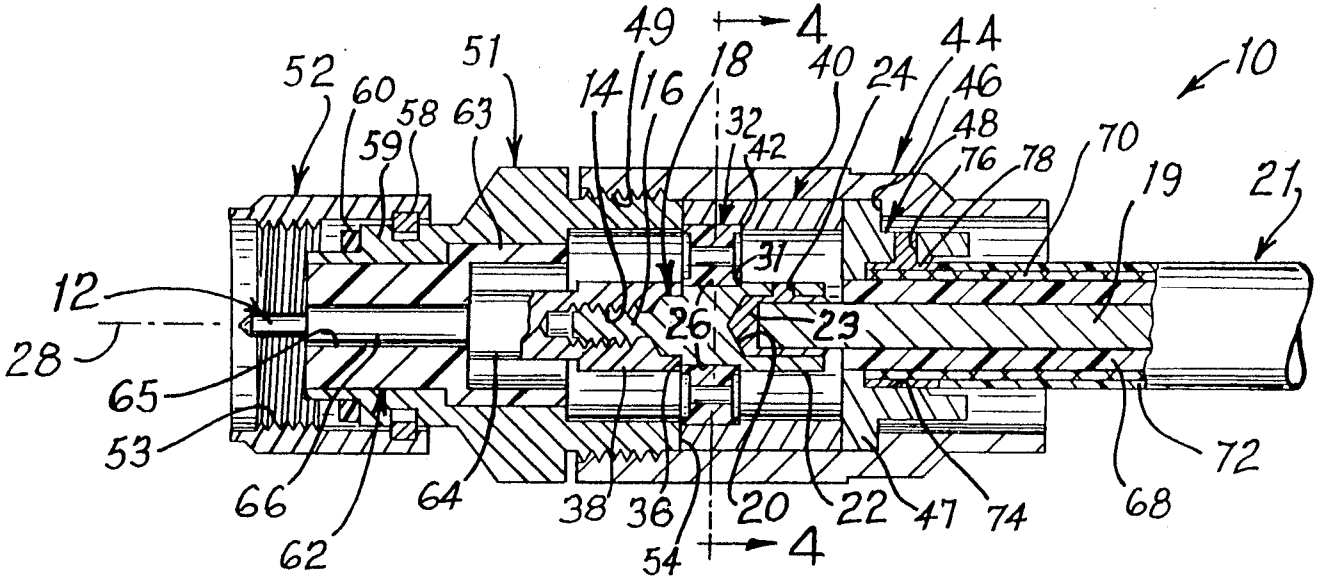
FIG. 7 is an enlarged axial sectional view of the coaxial connector of FIG. 3 in its assembled configuration.
Figure 8:
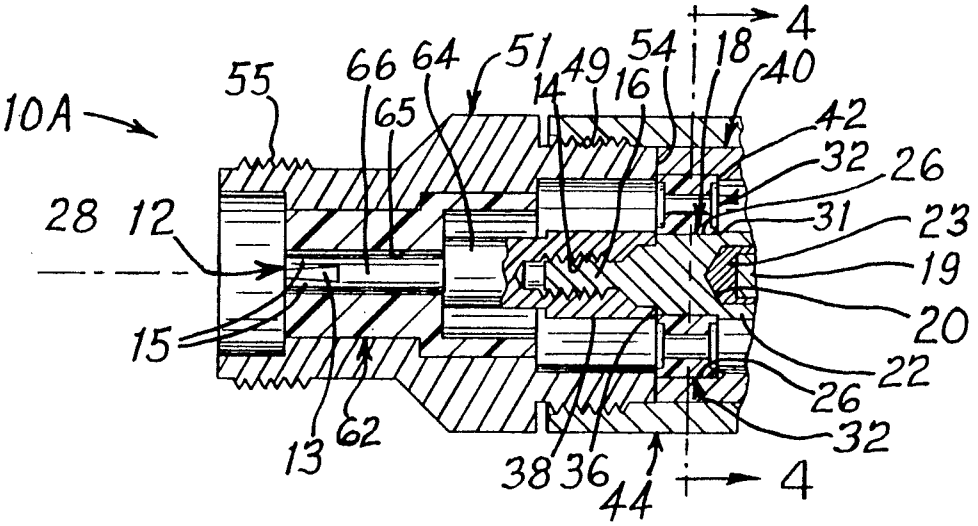
FIG. 8 is an enlarged partial axial sectional view of the front portion of a coaxial connector which is identical with that shown in FIG. 7, except that FIG. 8 shows the front end of a female connector

As shown in FIGS. 3 and 7, a coaxial connector 10 embodying the present invention has an electrically conductive center contact 12 extending forwardly at its front end. This center contact 12 is adapted to mate with an opposed center contact (as shown in FIG. 8) of another connector or connection 10A when the connector 10 is used. The center contact 12 has a screw-threaded axial socket 14 (FIG. 7) at its rear end for mounting it as shown in FIG. 7 onto a threaded stud 16 projecting axially from the front end of an electrically conductive center contact support member 18.

Figure 1:
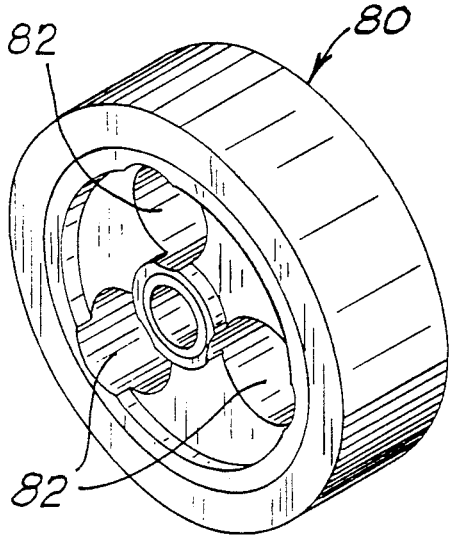
FIG. 1 (PRIOR ART)
FIG. 1 is an enlarged perspective view of a dielectric bead as used in the prior art.
Figure 2:
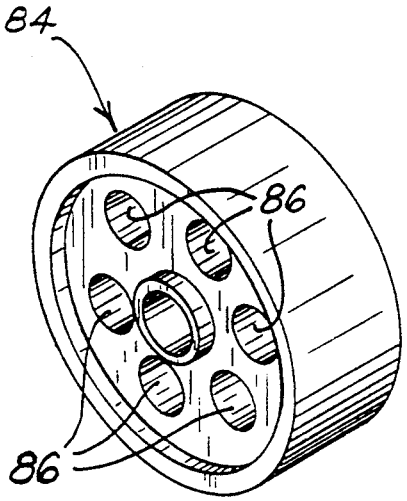
FIG. 2 (PRIOR ART)
FIG. 2 is an enlarged perspective view of another dielectric bead as used in the prior art.
Figure 4:
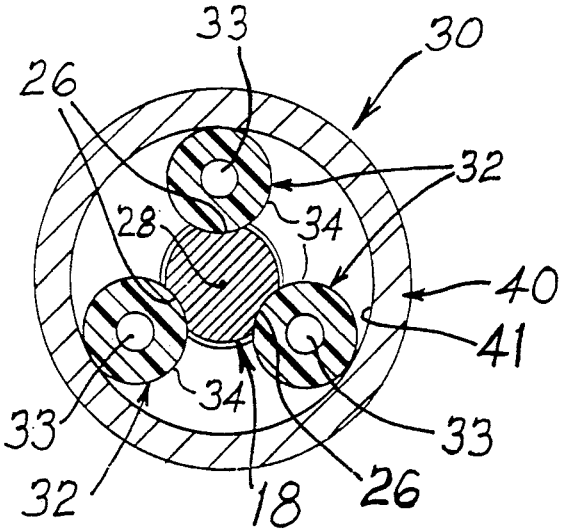
FIG. 4 is an enlarged partial cross-sectional view taken along the plane 4—4 in FIG. 7 or taken along the plane 4—4 in FIG. 8.

In order to receive and solder a center conductor 19 of a coaxial cable 21, the center contact support member 18 includes an axial socket 20 in an enlarged cylindrical portion 22 at the rear end of the support member 18. A radial solder hole 24 facilitates soldering attachment 23 of a coaxial cable center conductor 19 inserted into the socket 20, thereby electrically connecting the cable center conductor 19 with the center contact support member 18. The center conduction path extends axially from the cable conductor 19 through the support member 18 to the center contact 12, which is rigidly mechanically connected onto the threaded stud 16, thereby providing electrical connection to the contact 12. On the support member 18 located in front of the enlarged cylindrical portion 22 there are three (only two are seen in FIG. 3) uniformly angularly spaced, cylindrically concave seats 26 spaced 120° around the axis 28 of the connector 10 for providing an advantageous dielectric bead captivation assembly 30 (FIG. 4). A captivating shoulder 31 (See also FIG. 7) is defined at the front end of the enlarged portion 22 which abuts against the rear ends of the three concave seats 26.

Three identical short-cylindrical dielectric elements 32 (FIG. 6) each having a right circular cylindrical configuration are seated in mating relation into the respective seats 26. The dielectric elements 32 are captured at their rear ends by the shoulder 31, as seen most clearly in FIGS. 7 and 8, for firmly and rigidly preventing these dielectric elements 32 from moving rearwardly relative to the center contact support member 18. Conversely, the center contact support member 18 is rigidly prevented from moving forwardly relative to the captivating elements 32.

Figure 5:
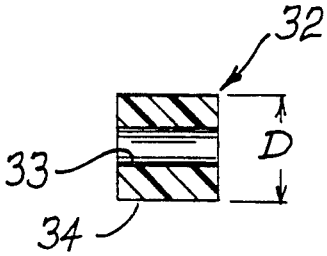
FIG. 5 is an enlarged axial sectional view of a cylindrical dielectric element which can be used in a coaxial connector embodying the invention.

As shown in FIG. 4, it is preferred for optimum firmness and rigidity in captivating and holding the center contact support member 18 that each concave seat 26 exactly mate with the peripheral surface 34 (FIGS. 4, 5 and 6) of diameter D of the dielectric element 32 seated into the respective seat 26 for holding the three dielectric elements 3 in their precisely predetermined geometric relationship uniformly spaced 120 apart around the connector axis 28. In other words, the radius of each concave seat 26 is preferred to be substantially equal to the radius of the convex peripheral surface 34 of each short cylindrical dielectric element 32.

For firmly and rigidly preventing these dielectric elements 32 from moving forwardly relative to the center contact support member 18, as seen in FIGS. 3, 7 and 8, a rear end surface 36 of an enlarged cylindrical rear portion 38 of the connector center contact 12 forms a shoulder abutting against the front ends of the three dielectric elements 32. The enlarged cylindrical portion 38 of the center contact 12 has the same outside diameter (O.D.) as the enlarged cylindrical portion 22 of the center contact support member 18.

A hollow circular cylindrical outer ring retainer 40 having an internal wall surface 41 and an internal annular shoulder 42 retains the dielectric elements 32 in intimate seating relationship on their respective concave seats 26. The annular shoulder 42 abuts against the rear ends of the dielectric elements 32 for preventing them from moving rearwardly relative to this retainer ring 40. This retainer ring 40 is held by a clamp body barrel 44 having an inner annular shoulder 46 (FIG. 7) abutting against the rear face of a flange 47 (FIG. 3) on a solder sleeve 48 which in turn abuts against the rear end of the retainer ring 40 for securely holding it in place for preventing it from moving rearwardly relative to the barrel 44. Internal screw threads 49 at the forward end of the clamp body barrel 44 receive an exterior threaded rear portion 50 of a front body coupling 51 having mounted thereon a rotatable coupling nut 52 with internal threads 53 at its front end for making a connection with an opposed coaxial device, for example such as is shown in FIG. 8. A rear surface 54 of the front body coupling 51 forms a shoulder abutting against the front of the retainer ring 40 for preventing it from moving forwardly relative to the clamp body barrel.

In FIG. 3, it is to be understood that the outer surface 56 of the coupling nut 52 may be roughened by knurling as indicated at 57 for increasing manual gripping, or it may have a hexagonal or other external grip-enhancing shape. This coupling nut 52 is rotatably mounted on a forward portion 59 of the front body coupling 51 by a split retainer ring 58 engaging in appropriate inner and outer grooves, as seen in FIG. 7. A gasket 60 is shown encircling a forward portion 59 of the front body coupling 51.

A dielectric sleeve 62 is shown in FIGS. 3, 7 and 8 having an enlarged rear portion 63 encircling and spaced radially outwardly from an intermediate-size region 64 of the center contact 12. A bore 65 in this dielectric sleeve 62 fits around a shank portion 66 of the center contact 12, and the front end of this dielectric sleeve 62 fits into the front portion 59 of the front body coupling 51. This dielectric sleeve 62 is made from dielectric material exhibiting relatively low electrical losses in the gigaHertz frequency range, for example, this dielectric sleeve 62 is preferred to be formed of PTFE plastic material, as is commercially obtainable under the trademark "TEFLON".

In an alternative embodiment, this dielectric sleeve 62 is omitted, and air serves as the dielectric material within the forward portion of the front body coupling 51; this air dielectric encircles the center contact shank 66. It is noted that in using the dielectric sleeve 62 as shown in FIGS. 7 and 8, there may be a region of air dielectric within the rear portion 63 of sleeve 62, this air dielectric encircling the intermediate-size region 64 of the center contact 12 and being contiguous with a region of air dielectric encircling the enlarged rear portion 38 of the center contact 12.

Inviting attention to the coaxial cable 21 (FIG. 7) and the solder sleeve 48, it is noted that such a cable as known in the art includes the center conductor 19 and a suitable flexible dielectric 68 encircled by an outer conductor 70. For example this outer conductor 70 may be a braided conductor, concentric with the inner conductor 19. A tough, flexible insulating jacket 72 is shown surrounding the outer conductor 70. A forward portion of this outer conductor 70 is inserted into a rear socket 74 of the solder sleeve 48 having a radial solder hole 76 between the outer conductor 70 and the solder sleeve 48. Thus, the outer cable conductor 70 is electrically connected via the solder 78, sleeve 48 and its flange 47 to the clamp body barrel 44 and to the ring retainer 40, and thence to the outer body coupling 51.

In summary regarding the captivation assembly 30 of the three dielectric elements 32, it is noted that they are effectively locked in place in all directions: (1) axially front and rear, (2) radially in and out, (3) circumferentially in both directions. The dielectric elements 32 are captured in an axial direction between the annular shoulder 42 at the rear, and the abutting shoulder of surface 54 at the front provided by front body coupling 51. This coaxial connector 10 includes outer conductor means comprising: retainer ring 40, clamp body barrel 44 and front body coupling 51. Thus, by engagement of inner wall surface 41 (FIG. 4) against the dielectric elements 32, they are held firmly and securely in fixed relationship relative to the outer conductor means comprising the assembly of the retainer ring 40, clamp body barrel 44 and front body coupling 51.

Moreover, these dielectric elements 32 are held securely and firmly in their geometric relationship uniformly spaced 120° around the connector axis 28 by their seating engagement in their respective concave seats 26. They are radially retained firmly and securely in place by the closely encircling cylindrical wall surface 41 (Please see FIG. 4) of the retainer ring 40. Furthermore, the center conductor means comprising the assembly of the connector center contact 12 and its support member 18 are firmly and securely held in position in all directions: axially front and rear, radially and circumferentially in both directions by the captivation action provided by the assembly 30 of the three dielectric elements 32 engaging inwardly against their concave seats 26 and captured between the shoulder 31 at the rear and the abutting shoulder of surface 36 at the front.

The short cylindrical dielectric elements 32 are fabricated from tough, durable, relatively high mechanical strength plastic material, for example, from a high performance engineering plastic material which exhibits relatively low electrical losses in the GHz frequency range. It is important that their mechanical strength be as high as reasonably attainable both in shear and in compressibility and that they also have an operating temperature range exceeding the specified temperature range for the connector 10 while at the same time having a relative low dielectric constant and relatively low electrical losses at the GHz operating frequencies. A material we have found to be successful for fabricating these dielectric elements 32 is polyether imide resin commercially available from General Electric Company under their trademark ULTEM.

In order further to reduce the effective overall dielectric constant of the entire captivation assembly 30 each dielectric element 32 is shown provided with an axial through hole 33.

Figure 6:
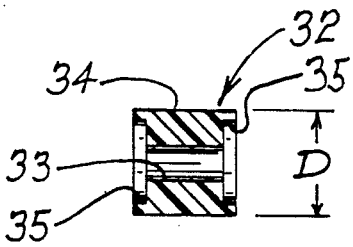
FIG. 6 is an enlarged axial sectional view of a modified form of a cylindrical dielectric element which can be used in a coaxial connector embodying the invention. It is this FIG. 6 form of the dielectric element which is shown in FIGS. 3, 7 and 8.

If it is desired that operating characteristics of the connector 10 be such that capacitances arising from conductor steps, i.e. arising from changes in conductor diameter, such as occur at 31 and 42 and at 36 and 54, be provided with impedance compensation, then such compensation may be provided, as will now be explained. Such compensation is provided by fabricating compensation steps 35 (FIG. 6) in the ends of each dielectric element 32 by counterbore enlargement of the through holes 33 to a shallow depth, as seen most clearly in FIG. 6. Thus, the form of dielectric element 32 as shown in FIG. 6 is most preferred for optimum performance of a coaxial connector 10 at very high frequencies in the GHz range, for example at 50 to 60 GHz or even higher. The form of dielectric element 32 shown in FIG. 5 with a through hole 33 and without compensation steps is preferred for use in connectors 10 where optimum performance at such very high GHz frequencies is not such an important factor.

These dielectric elements 32, for example, advantageously can be formed from round rods of the desired dielectric material by cutting them to the desired length and then by drilling them at 33 or at 33 and 35, as may be desired.

The female coaxial connector 10A shown in FIG. 8 may be the same as any of the various embodiments of the male connector 10 described above, except for differences as shown and described. The front body coupling 51 is shown having an external thread 55 for receiving a coupling nut, such as shown at 52 in FIGS. 3 and 7. The center contact 12 has a socket 13 at its front end formed by a plurality of forwardly extending resilient fingers 15 on the shank 66 for receiving the front end of the center contact 12 of the male connector 10.

As used herein, the term "coaxial connector" is intended to be interpreted sufficiently broadly to include any coaxial device wherein the claimed invention may be embodied usefully. For example, this term "coaxial connector" is intended to include coaxial devices such as coaxial connectors, coaxial adaptors, coaxial plugs, coaxial jacks, coaxial terminations, and the like. Also, it is noted that for convenience of illustration, SMA Type of Male and Female coaxial connectors are shown. A coaxial connector of any type wherein the claimed invention may be embodied usefully is intended to be included within the meaning of "coaxial connector".

Since other changes and modifications varied to fit particular operating requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

We claim:

1. A coaxial connector having an axis with forward and rear directions relative to said axis, said coaxial connector comprising:

center conductor means concentric with said axis and having a plurality of concave seats facing radially outwardly;

said concave seats each having a concave surface extending straight forwardly and rearwardly;

each straight concave seat being parallel with said axis;

a plurality of dielectric elements engaging individually in respective ones of said concave seats;

said dielectric elements each having a straight external surface extending forwardly and rearwardly;

each straight external surface being parallel with said axis;

outer conductor means encircling said dielectric elements in contact with a portion of the straight external surface of each dielectric element for retaining them engaged in their respective concave seats for positioning said center conductor means concentrically relative to said outer conductor means; and;

captivating means for preventing said dielectric elements from moving forwardly and rearwardly relative to said inner conductor means and also relative to said outer conductor means for positioning said center conductor means forwardly and rearwardly relative to said outer conductor means.

2. A coaxial connector as claimed in claim 1, in which:

said captivating means for preventing said dielectric elements from moving forwardly and rearwardly relative to said inner conductor means comprise first and second shoulder means provided by said center conductor means abutting against said dielectric elements forwardly and rearwardly, respectively, of said dielectric elements; and said first and second shoulder means defining forward and rearward ends, respectively, of each straight concave surface.

3. A coaxial connector as claimed in claim 1, in which:

there are three concave seats angularly spaced apart 120° around said axis; and there are three dielectric elements angularly spaced apart 120° around said axis.

4. A coaxial connector having an axis with forward and rear directions relative to said axis, said coaxial connector comprising:

center conductor means concentric with said axis and having a plurality of concave seats facing radially outwardly;

a plurality of dielectric elements engaging individually in respective ones of said concave seats;

outer conductor means encircling said dielectric elements for retaining them engaged in their respective seats;

means for preventing said dielectric elements from moving forwardly and rearwardly relative to said inner and outer conductor means; and said means for preventing said dielectric elements from moving forwardly and rearwardly relative to said outer conductor means comprising shoulder means provided by said outer conductor means abutting against said dielectric elements both forwardly and rearwardly of said dielectric element;

thereby positioning said center conductor means both forwardly and rearwardly relative to said outer conductor means.

5. A coaxial connector as claimed in claim 4, in which:

said means for preventing said dielectric elements from moving forwardly and rearwardly relative to said outer conductor means prevent said dielectric elements from moving forwardly and rearwardly and radially relative to said center conductor means and relative to said outer conductor means for holding said center conductor means in position forwardly and rearwardly and radially relative to said outer conductor means.

6. A coaxial connector as claimed in claim 2, in which:

said center conductor means comprise an electrically conductive center contact extending along said axis forwardly relative to said dielectric elements and an electrically conductive support member extending along said axis rearwardly relative to said dielectric elements with means mechanically and electrically interconnecting said center contact and support member;

said center contact including said first shoulder means forwardly of each straight concave surface; and said electrically conductive support member including said second shoulder means rearwardly of each straight concave surface.

7. A coaxial connector as claimed in claim 6, in which:

said electrically conductive support member has said plurality of concave seats thereon facing radially outwardly.

8. A coaxial connector having an axis with forward and rear directions relative to said axis, said coaxial connector comprising:

center conductor means concentric with said axis and having a plurality of concave seats facing radially outwardly;

a plurality of dielectric elements engaging individually in respective ones of said concave seats;

outer conductor means encircling said dielectric elements for retaining them engaged in their respective seats;

means for preventing said dielectric elements from moving forwardly and rearwardly relative to said inner and outer conductor means;

said center conductor means comprising an electrically conductive center contact extending along said axis forwardly relative to said dielectric elements and an electrically conductive support member extending along said axis rearwardly relative to said dielectric elements with means mechanically and electrically interconnecting said center contact and support member;

said electrically conductive support member having said plurality of state therein facing radially outwardly;

said electrically conductive support member having an enlarged cylindrical portion at the rear thereof; and said means for preventing said dielectric elements from moving rearwardly relative to said inner conductor means comprise a front face of said enlarged cylindrical portion abutting against rear surfaces of said dielectric elements for preventing said dielectric elements from moving rearwardly relative to said electrically conductive support member;

thereby positioning said center conductor means both forwardly and rearwardly relative to said outer conductor means.

9. A coaxial connector as claimed in claim 8, in which:

said enlarged cylindrical portion of said electrically conductive support member has a rearwardly-facing socket for receiving therein a center conductor of a coaxial cable.

10. A coaxial connector as claimed in claim 8, in which:

said center contact has an enlarged cylindrical portion at the rear thereof;

a rear face of said enlarged cylindrical portion of said center contact abuts against front surfaces of said dielectric elements for preventing said dielectric elements from moving forwardly relative to said electrically conductive support member; and said enlarged cylindrical portion of said center contact and said enlarged cylindrical portion of said electrically conductive support member have substantially the same outside diameter.

11. A coaxial connector as claimed in claim 8, in which:

said enlarged cylindrical portion at the rear of said center contact has a rearwardly-facing, internally-threaded socket therein; and said electrically conductive support member has a forwardly-extending threaded stud screwed into said internally-threaded socket for mechanically and electrically interconnecting said center contact and said support member in relatively rigid mechanical relationship.

12. A coaxial connector having an axis with forward and rear directions relative to said axis, said coaxial connector comprising:

center conductor means concentric with said axis and having a plurality of concave seats facing radially outwardly;

a plurality of dielectric elements engaging individually in respective ones of said concave seats;

outer conductor means encircling said dielectric elements holding them in their respective seats;

means for preventing said dielectric elements from moving forwardly and rearwardly relative to said inner and outer conductor means;

said center conductor means comprising an electrically conductive center contact extending along said axis forwardly relative to said dielectric elements and an electrically conductive support member extending along said axis rearwardly relative to said dielectric elements with means mechanically and electrically interconnecting said center contact and support member;

said center contact having an enlarged cylindrical portion at the rear thereof; and said means for preventing said dielectric elements from moving forwardly relative to said inner conductor means comprise a rear face of said enlarged cylindrical portion of said center contact abutting against front surfaces of said dielectric elements for preventing said dielectric elements from moving forwardly relative to said electrically conductive support member;

thereby positioning said center conductor means both forwardly and rearwardly relative to said outer conductor means.

13. A coaxial connector having an axis with forward and rear directions relative to said axis, said coaxial connector comprising:

center conductor means concentric with said axis and having a plurality of concave seats facing radially outwardly;

a plurality of dielectric elements engaging individually in respective ones of said concave seats;

outer conductor means encircling said dielectric elements for retaining them engaged in said respective seats;

means for preventing said dielectric elements from moving forwardly and rearwardly relative to said inner and outer conductor means;

each of said dielectric elements being a right circular cylindrical element;

each of said dielectric elements having an axial bore extending therethrough; and each of said concave seats having a concave cylindrical surface mating with a circular cylindrical surface of one of said dielectric elements;

thereby positioning said center conductor means relative to said outer conductor means.

14. A coaxial connector as claimed in claim 13, in which:

said axial bore in each of said dielectric elements is enlarged at the front and rear thereof.

15. A coaxial connector as claimed in claim 13, in which:

said outer conductor means includes a hollow cylindrical retainer ring having an inner wall surface encircling said plurality of dielectric elements and engaging each of said dielectric elements for retaining them engaged in their respective seats; and said retaining ring has a forwardly-facing internal annular shoulder abutting against rear surfaces of said dielectric elements for preventing said dielectric elements from moving rearwardly relative to said retainer ring.

16. A coaxial connector as claimed in claim 15, in which:

said outer conductor means also includes a clamp body barrel positioned around said retainer ring and a front body coupling;

said front body coupling being in screw-threaded engagement into a front portion of said clamp body barrel; and said front body coupling having a rearwardly-facing surface abutting against front surfaces of said dielectric elements for preventing said dielectric elements from moving forwardly relative to aid retainer ring.

17. A captivation assembly for use in a coaxial connector for supporting and retaining inner conductor means on an axis relative to concentric outer conductor means, said captivation assembly comprising:

inner conductor means including an electrically conductive member on the axis;

said conductive member having a plurality of concave seats thereon facing radially outwardly from the axis;

each of said concave seats having a concave cylindrical surface;

each concave cylindrical surface extending straight parallel with said axis;

a plurality of dielectric elements;

each of said dielectric elements having a cylindrical outer surface extending straight parallel with said axis;

respective dielectric elements being seated in respective seats with a portion of the straight cylindrical outer surface of each dielectric element mating with a straight concave cylindrical surface of a respective seat; and outer conductor means concentric with said axis encircling said dielectric elements in contact with said dielectric elements for holding them radially seated in their respective seats.

18. A captivation assembly as claimed in claim 17 having forward and rear directions, in which:

said inner conductor means engages said dielectric elements forward and rearward of said dielectric elements by means of forward and rearward shoulders respectively located at forward and rearward limits of each straight concave surface for preventing said inner conductor means from moving forwardly and rearwardly relative to said dielectric elements.

19. A captivation assembly as claimed in claim 17 having forward and rear directions, in which:

said outer conductor means engages said dielectric elements forward and rearward of said dielectric elements for preventing said dielectric elements from moving forwardly and rearwardly relative to said outer conductor means.

20. A captivation assembly as claimed in claim 17 having forward and rear directions, in which:

said inner conductor means engage said dielectric elements forward and rearward of said dielectric elements at forward and rearward ends of each straight concave surface for preventing said inner conductor means from moving forwardly and rearwardly relative to said dielectric elements; and said outer conductor means engage said dielectric elements forward and rearward of said dielectric elements for preventing said dielectric elements from moving forwardly and rearwardly relative to said outer conductor means;

thereby preventing said inner conductor means from moving forwardly and rearwardly relative to said outer conductor means.

21. A captivation assembly for use in a coaxial connector for supporting and retaining inner conductor means on an axis relative to concentric outer conductor means, said captivation assembly comprising inner conductor means including an electrically conductive member on the axis;

said conductive member having a plurality of concave seats thereon facing radially outwardly from the axis;

a plurality of dielectric elements;

respective dielectric elements being seated in respective seats;

outer conductor means concentric with said axis encircling said dielectric elements holding them seated in their respective seats;

said captivation assembly having forward and rearward directions;

said inner conductor means engaging said dielectric elements for preventing said inner conductor means from moving forwardly and rearwardly relative to said dielectric elements;

said outer conductor means engaging said dielectric elements for preventing said dielectric elements from moving forwardly and rearwardly relative to said outer conductor means;

thereby preventing said inner conductor means from moving forwardly and rearwardly relative to said outer conductor means;

said inner conductor means including an electrically conductive contact in addition to said electrically conductive member;

said contact being electrically connected to said conductive member; and said contact being mechanically supported by said conductive member.

22. A captivation assembly as claimed in claim 21, in which:

said contact has a surface engaging said dielectric elements for preventing them from moving forwardly relative to said conductive member.

23. A captivation assembly as claimed in claim 21, in which:

said conductive member has a forwardly extending conductive threaded stud; and said contact has a threaded socket screwed onto said threaded stud in electrical and mechanical engagement with said threaded stud.

24. A captivation assembly for use in a coaxial connector for supporting and retaining inner conductor means on an axis relative to concentric outer conductor means, said captivation assembly comprising:

inner conductor means including an electrically conductive member on the axis;

said conductive member having a plurality of concave seats thereon facing radially outwardly from the axis;

a plurality of dielectric elements;

respective dielectric elements being seated in respective seats;

outer conductor means concentric with said axis encircling said dielectric elements holding them seated in their respective seats;

said captivation assembly having forward and rearward directions;

said inner conductor means engaging said dielectric elements for preventing said inner conductive means for moving forwardly and rearwardly relative to said dielectric elements;

said outer conductor means engaging said dielectric elements for preventing said dielectric elements from moving forwardly and rearwardly relative to said outer conductor means;

thereby preventing said inner conductor means from moving forwardly and rearwardly relative to said outer conductor means;

each of said dielectric elements being a right circular cylinder having a circular cylindrical surface;

each of said dielectric elements having an opening extending therethrough from front to rear thereof; and each of said concave seats having a concave cylindrical seat surface mating with a circular cylindrical surface of one of said dielectric elements.

25. A captivation assembly as claimed in claim 24, in which:

there are three of said concave cylindrical seat surfaces angularly spaced 120° apart around the axis, and said right circular cylindrical dielectric elements are angularly spaced 120° apart around the axis.

26. A captivation assembly as claimed in claim 24, in which:

said opening in each of said dielectric elements extends through the respective dielectric element concentric with the circular cylindrical surface of the respective dielectric element.

27. A captivation assembly as claimed in claim 26, in which:

said opening in each of said dielectric elements is enlarged at the front and rear of the respective dielectric element.

28. In a coaxial connector for operation at gigaHertz frequencies and wherein said coaxial connector has a main axis with forward and rear directions along said main axis, a captivation assembly comprising:

inner conductive means on said main axis of said coaxial connector;

outer conductive means being spaced radially outwardly from said main axis and encircling said main axis;

said outer conductive means being spaced radially outwardly from said inner conductive means and encircling said inner conductive means;

said inner conductive means including means defining a plurality of concave seats facing radially outwardly;

said concave seats being uniformly angularly spaced around said axis;

each of said concave seats having a respective concave circularly cylindrical surface of a predetermined radius and whose axis extends parallel with said main axis;

a plurality of dielectric elements;

respective ones of said dielectric elements being seated in respective ones of said concave seats;

each of said dielectric elements having a circularly cylindrical peripheral surface of predetermined radius and whose axis extends parallel with said main axis;

the predetermined radius of each circularly cylindrical peripheral surface being substantially equal to the predetermined radius of each concave circularly cylindrical surface;

said outer conductive means including means holding said dielectric elements captive in their respective concave seats for holding said inner conductive means in concentric aligned relationship with respect to said outer conductive means;

said inner conductive means being adapted to make electrical connections at forward and rear portions thereof; and said outer conductive means being adapted to make electrical connections at forward and rear portions thereof.

29. In a coaxial connector for operation at gigaHertz frequencies and wherein said coaxial connector has forward and rear directions, a captivation assembly comprising:

inner conductive means on an axis of said coaxial connector;

outer conductive means spaced radially outwardly from said axis and encircling said axis;

said inner conductive means including means defining a plurality of concave seats facing radially outwardly;

said concave seats being uniformly angularly spaced around said axis;

a plurality of dielectric elements;

respective ones of said dielectric elements being seated in respective ones of said concave seats;

said outer conductive means including means holding said dielectric elements captive in their respective concave seats for holding said inner conductive means in concentric relationship with respect to said outer conductive means;

said inner conductive means being adapted to make electrical connections at forward and rear portions thereof;

said outer conductive means being adapted to make electrical connections at forward and rear portions thereof; and wherein:

said dielectric elements are circular cylindrical in configuration and each has an opening therein positioned concentrically with respect to its circular cylindrical configuration; and said concave seats conform in mating relationship with said circular cylindrical configuration of said dielectric elements.

30. In a coaxial connector, a captivation assembly as claimed in claim 29, in which:

said inner conductive means includes means for preventing said inner conductive means from moving forwardly and rearwardly with respect to said dielectric elements;

said outer conductive means include means for preventing said dielectric elements from moving forwardly and rearwardly with respect to said outer conductive means;

thereby preventing said inner conductive means from moving forwardly and rearwardly with respect to said outer conductive means.

31. In a coaxial connector, a captivation assembly as claimed in claim 30, in which:

said openings of said dielectric elements are enlarged at the forward and rear thereof.

* * * * *